US007523995B2

(12) United States Patent
Rio et al.

(10) Patent No.: US 7,523,995 B2
(45) Date of Patent: Apr. 28, 2009

(54) MILLING MACHINE

(75) Inventors: Federico B. Rio, Bologna (IT); Dean R. Potts, Maple Grove, MN (US); Gregory H. Dubay, Bologna (IT); Dario Sansone, Castello d'Argile (IT)

(73) Assignee: Caterpillar Paving Products Inc., Minneapolis, MN (US)

( * ) Notice: Subject to any disclaimer, the term of this patent is extended or adjusted under 35 U.S.C. 154(b) by 440 days.

(21) Appl. No.: 11/180,688

(22) Filed: Jul. 14, 2005

(65) Prior Publication Data

US 2006/0024134 A1 Feb. 2, 2006

(30) Foreign Application Priority Data

Jul. 15, 2004 (IT) ..... TO2004A0499

(51) Int. Cl.
*E01C 23/088* (2006.01)

(52) U.S. Cl. ..... 299/39.6; 404/90; 180/209; 299/39.4

(58) Field of Classification Search ..... 299/1.4, 299/1.5, 39.1, 39.3, 39.4, 39.6; 180/209; 280/43, 43.17, 6.155; 404/84.05, 90, 93, 404/94

See application file for complete search history.

(56) References Cited

U.S. PATENT DOCUMENTS 4,558,758 A * 12/1985 Littman et al. ..... 180/8.1
5,127,335 A 7/1992 Whitaker et al.
6,481,924 B1 11/2002 Smolders et al.
2002/0175018 A1 * 11/2002 Strong ..... 180/412

FOREIGN PATENT DOCUMENTS

| | | |
|---|---|---|
| BE | 895198 A2 | 3/1983 |
| EP | 0 916 004 B1 | 9/1999 |
| EP | 1039037 | 9/2000 |
| WO | WO 02/103117 | 12/2002 |

* cited by examiner

*Primary Examiner*—Sunil Singh
(74) *Attorney, Agent, or Firm*—Finnegan, Henderson, Farabow, Garrett & Dunner

(57) ABSTRACT

Work machines such as road mills having a frame supported by tracked or wheeled ground engaging support units may require the ability to move one or more of the ground engaging units between projecting and retracted positions relative to the frame without reversing the running direction of the repositioned unit. A disclosed work machine has a machine frame supportable by a plurality of ground engaging units. A support device connected between the machine frame and at least one of the ground engaging units has a lifting column adapted to controllably raise and lower the ground engaging unit relative to the frame. A first actuator is connected to the support device to move the one ground engaging unit between the projecting and retracted positions, and a second actuator is connected to the lifting column to maintain the running direction of the associated ground engaging unit in each of the projecting and retracted positions.

63 Claims, 5 Drawing Sheets

MILLING MACHINE

TECHNICAL FIELD

The present invention relates generally to work machines for the treatment of roadway surfaces, and more particularly to a road planer or milling machine.

BACKGROUND

Road mills, sometimes called cold planers or scarifiers, are work machines that typically include a frame quadrilaterally supported by tracked or wheeled support units. The frame supports machine components, including an engine, an operator's station, and a milling drum. The milling drum, fitted with a plurality of milling tools, is rotated through a suitable interface by the engine to break up a road surface.

The support units generally include lift columns mounted between the frame and the tracks or wheels. Extending or retracting the lift columns raises or lowers the frame and milling drum relative to the tracks or wheels and, consequently, relative to the ground. At least one of the support units, typically a rear unit, is commonly constructed in a manner permitting it to swing or pivot between two different operating positions: a projecting position in which the track or wheel is positioned substantially outside of the boundaries of the machine frame for maximum stability, and a retracted position in which the track or wheel is positioned substantially within the boundaries of the machine frame to enable the machine to mill road surfaces close to a curb or wall, for example.

Typically, the tracks or wheels, including the pivotable unit, are driven for traction purposes by individual hydraulic motors. The necessary pressurized hydraulic fluid is supplied by a pump driven by the frame mounted engine. To move the pivotable support unit from one position to the other position, an operator uses the lift column to lower the frame with respect to the support unit until the milling drum (or another frame mounted component) rests on the ground. Continued operation of the lift column raises the track or wheel off the ground so that the support unit can be pivoted. However, absent some correction mechanism, repositioning the support unit in this manner also causes the track or wheel to reverse its direction of rotation or running direction. Consequently, it is desirable to counter-rotate the track or wheel relative to the rotation caused by the repositioning to maintain the original alignment and direction of rotation, regardless of whether the support unit is in the projecting or retracted position.

EP 0 916 004 proposes using a guide-rod gear to provide a pivotable support unit with a counter-rotatable wheel. The guide-rod gear is shown connected between the machine frame and the support unit, and consists of a four-bar linkage mechanism having four vertical articulated axles and two guide rods pivotable in a horizontal plane. A single hydraulic actuator causes the four-bar or parallelogram type linkage to pivot the rear wheel supported by a non-rotatable lift column between the projecting and retracted positions, while counter-rotating the wheel and lift column. This design causes the weight of the machine resting on the pivotable rear wheel to be carried by the four-link mechanism, which may result in reduced stability and stiffness of the machine. Also, precise and potentially wear-prone couplings have to be employed.

Further, road mills must be steered, and optimum steering angles differ in accordance with the well-known Ackerman principle when the support unit is in the retracted position versus the projecting position. This is a particular problem when the machine is fitted with tracks instead of wheels, because the rear tracks, especially the retracted rear track, must be steered in concert with the front tracks to avoid dragging or skipping of the rear tracks on the road surface. The single actuator guide-rod system of EP 0 916 004 does not provide integrated steering capability of the pivotable rear wheel, and is not well suited for use with machines fitted with tracks.

International publication WO 02/103117 describes another road mill of the general construction discussed above, and offers improvements over the guide-rod system. Instead of a four-bar linkage, the support unit is mounted on a sturdy support or swing arm that is pivotally connected to the machine frame with a single large pivot pin. This arrangement eliminates the need for a multi-piece linkage, such as the guide rod gear, with numerous pivot joints. The support arm may be pivoted by means of a linear hydraulic cylinder connected between the arm and the frame. A second linear hydraulic cylinder is described connected between the support arm and an axially rotatable portion of the lift column that is, in turn, connected to the track or wheel. When the support arm is pivoted by the one hydraulic cylinder the track or wheel may be counter-rotated by the other hydraulic cylinder, allowing the support unit to swing between the projecting and retracted positions while maintaining constant the running direction of the associated track or wheel. Because of the independent action of the two hydraulic cylinders, steering of the pivotable track or wheel can be accomplished using the second hydraulic cylinder, making this design suitable for use with machines fitted with either tracks or wheels.

The above described mechanisms provide different solutions to the problem of pivoting a machine support unit between projecting and retracted positions while maintaining the running direction of the pivoted track or wheel, but both solutions place bulky mechanical devices at a location on the support unit which must fit into a tightly confined space, especially in the retracted position. In addition, the guide rod gear arrangement is not suitable for steering the support unit, and fine steering control can be difficult to achieve using the hydraulic linear cylinder arrangement. The present invention is directed to overcoming one or more of these and other problems or disadvantages associated with the prior art.

SUMMARY OF THE INVENTION

In accordance with one embodiment of the present invention, there is provided a work machine having a frame supportable by a plurality of ground engaging units. A support device is connected between the frame and at least one of the ground engaging units, and a first actuator connected to the support device is adapted to move the one ground engaging unit between projecting and retracted positions relative to the frame. A second actuator associated with the one ground engaging unit is adapted to maintain the same rotational direction of the ground engaging unit in each of the projecting and retracted positions. A controller coordinates the actuation of the first and second actuators, at least one of which is a rotary actuator.

In accordance with another embodiment of the present invention, there is provided a work machine having a frame supportable by a plurality of ground engaging units. A support device is connected between the frame and at least one of the ground engaging units, and includes a lifting column adapted to controllably raise and lower the associated ground engaging unit relative to the frame. A first actuator is connected to the support device and is adapted to move the one ground engaging unit between projecting and retracted positions relative to the frame. A second actuator is positioned at a location linearly spaced apart from the first actuator along an axis of the lifting column and is adapted to cause at least a portion of the column to rotate relative to the machine frame about the column axis.

In accordance with another embodiment of the present invention, there is disclosed a method of controlling a pair of actuators connected to a controller to selectively position one of a plurality of ground engaging units connected to a respective lifting column and supporting a frame of a self-propelled work machine. The method includes the steps of raising the one ground engaging unit with the lifting column until the unit is free from engagement with the ground, actuating a first one of the actuator pair to move the ground engaging unit from one to the other of the projecting and retracted positions relative to the machine frame, actuating a second one of the actuator pair to rotate the one ground engaging unit about the lifting column axis in a manner coordinated with the actuation of the first actuator to maintain the same rotational direction of the ground engaging unit in each of the projecting and retracted positions, and lowering the one ground engaging unit with the lifting column until the unit is again in frame supporting engagement with the ground.

DETAILED DESCRIPTION

Figure 1:
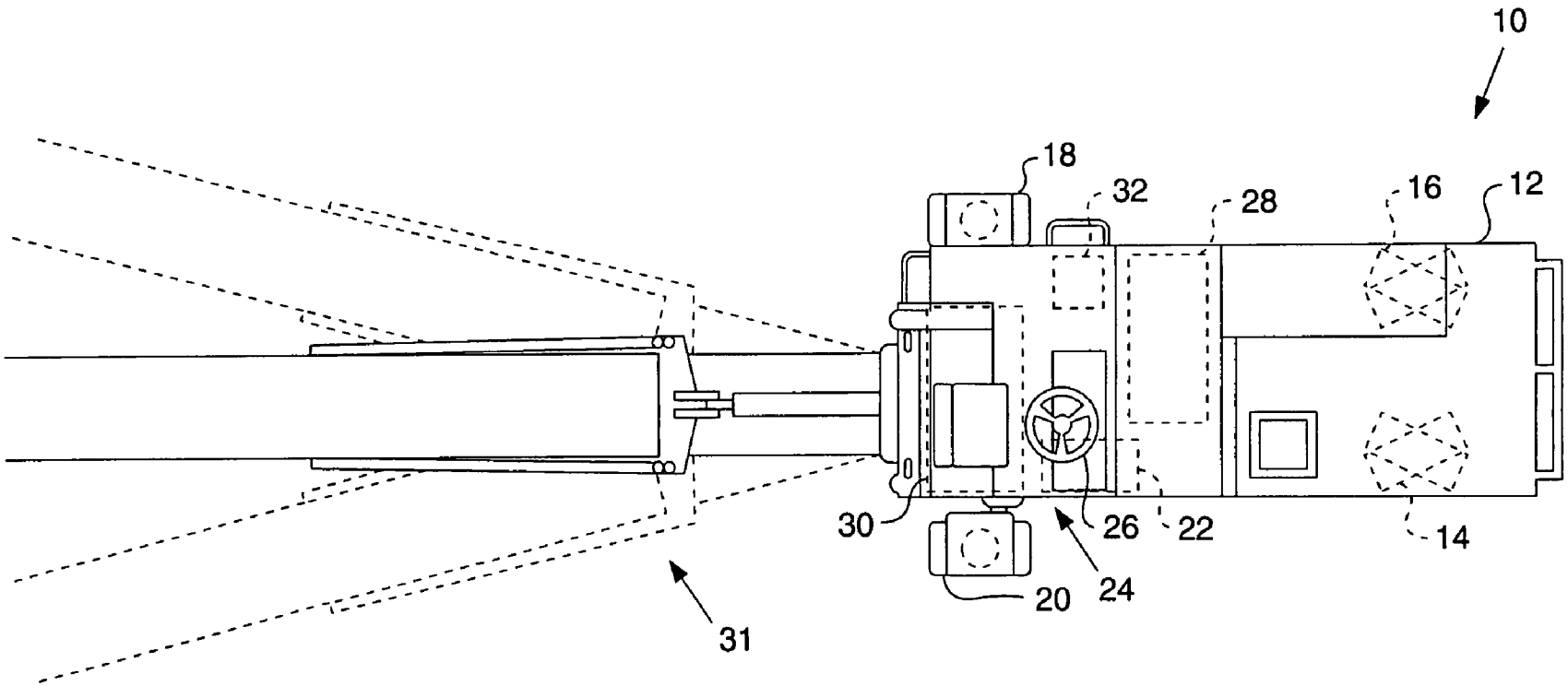
FIG. 1 is a line drawing of a top plan view of a work machine in which features of the present invention may be incorporated.

The self-propelled work machine 10 of FIG. 1 includes a machine frame 12 supportable by a plurality of ground engaging units 14, 16, 18, 20. In a preferred embodiment, the plurality of ground engaging units 14, 16, 18, 20 includes a pair of front ground engaging units 14, 16 and a pair of rear ground engaging units 18, 20. The ground engaging units 14, 16, 18, 20 each include either a wheel or a track section. At least one of the ground engaging units 14, 16, 18, 20, for example, the right rear ground engaging unit 20 as seen from the operator's perspective, may be pivotable between a projecting position as shown in solid lines in FIG. 1 and a retracted position in which the one ground engaging unit 20 is positioned within the frame 12 as indicated by the recess 22 shown in hidden lines.

The frame 12 also supports an operator's station 24 having a steering command element 26, an engine 28 such as an internal combustion engine, and a milling roller 30. The steering command element 26 is shown to include a steering wheel, but other steering devices such as a joystick of levers could be used as well. The engine 28 supplies power to drive one or more of the ground engaging units 14, 16, 18, 20 to propel the work machine 10 relative to the ground. In a preferred embodiment, this is accomplished by driving a hydraulic pump with an output of the engine 28, which in turn supplies high pressure hydraulic fluid to individual hydraulic motors associated with the ground engaging units 14, 16, 18, 20. This conventional hydraulic drive is well-known in the pertinent art and is not depicted in the drawings. The engine 28 also supplies power to rotate the milling roller 30, for example, to break up a road surface. The broken up material may be carried away from the work machine 10 by a conveyor 31.

Steering the front ground engaging units 14, 16 of the machine 10 may be accomplished in a conventional manner using a mechanical linkage from the steering command element 26 to the front ground engaging units 14, 16, or by detecting motion of the steering command element 26 using an appropriate transducer to sense the desired steering motion and responsively controlling an actuator such as a hydraulic cylinder associated with the front ground engaging units 14, 16. This may be accomplished, for example, by delivering steering command signals from the steering command element 26 to a controller 32 carried on the machine frame 12, such as a programmed computer logic unit and associated memory. In a manner well-known in the art, the controller 32 would translate the steering command signals into appropriate actuation signals delivered to the actuator associated with the front ground engaging units. Such steering devices are well known in the art and are not depicted in the drawings.

Steering the rear ground engaging units 18, 20 of the machine 10 is more complicated, because the one rear ground engaging unit 20 may either be in the projecting position where it is axially aligned with the other rear ground engaging unit 18, or in the retracted position where it is not axially aligned with the other rear ground engaging unit 18. Depending on the position of the one ground engaging unit 20, the steering angle of the one ground engaging unit 20 may require correction in accordance with the well-known Ackerman principle to properly coordinate the steering effect with the steering angle of the front ground engaging units 14, 16. Such correction may be provided by the controller 32 as is discussed more fully below.

Figure 2:
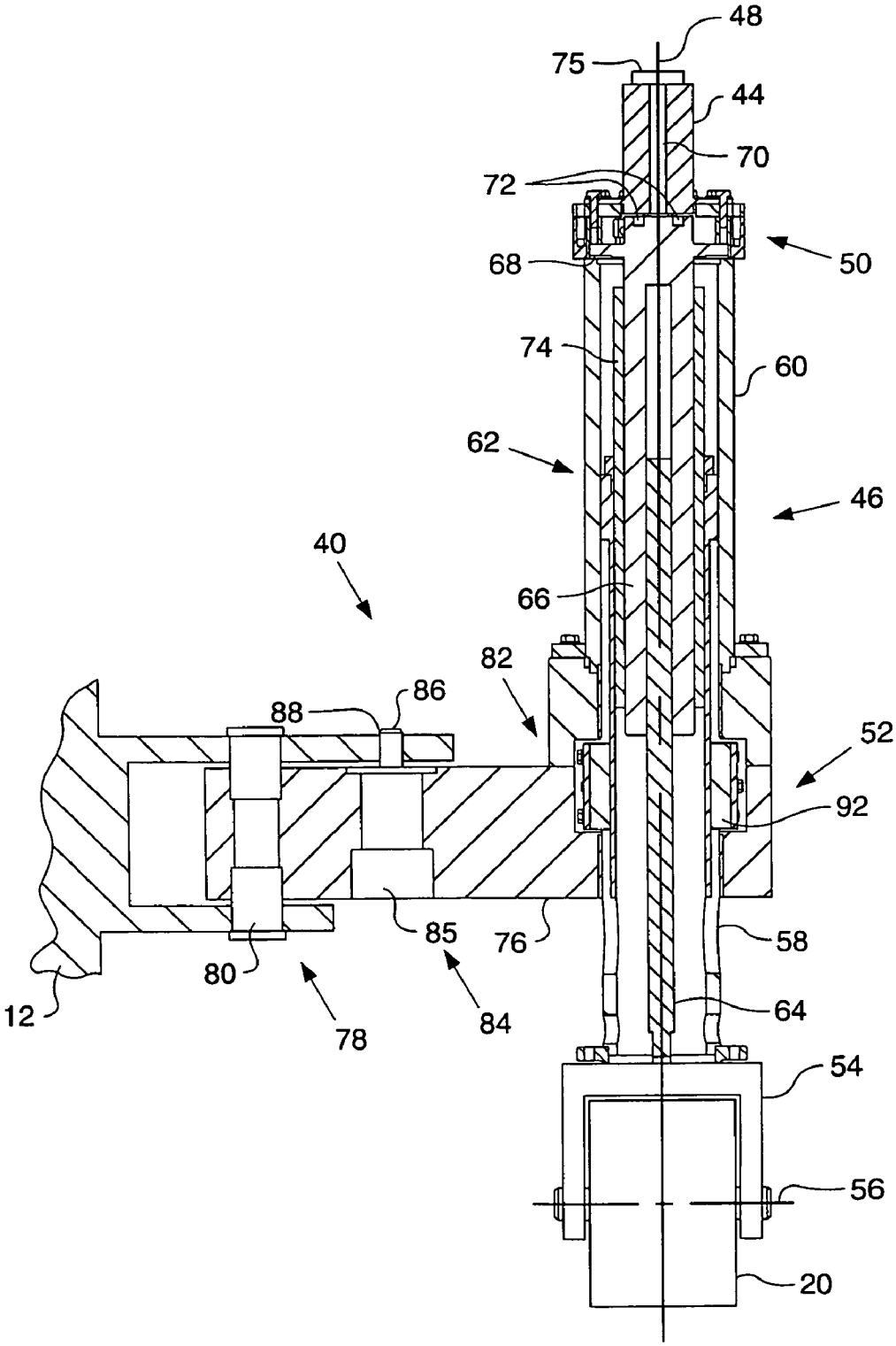
FIG. 2 is a partially sectioned longitudinal view of a detail of a cold planer as depicted in FIG. 1, showing an articulation apparatus of a preferred embodiment of the present invention.
Figure 3:
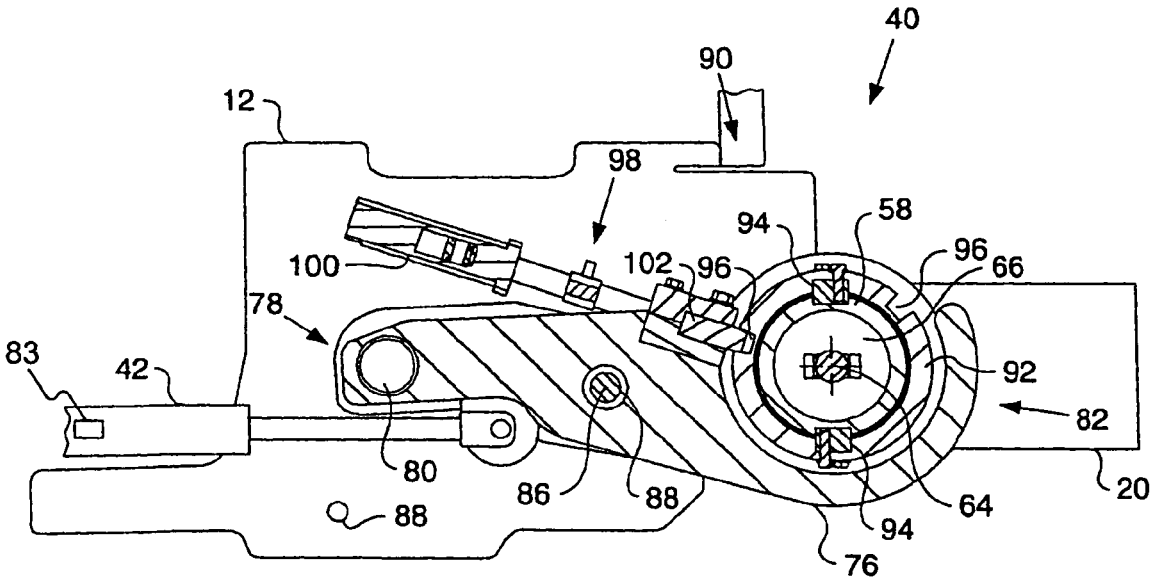
FIG. 3 is a partially sectioned top plan view of the apparatus of FIG. 2, with the ground engaging unit arranged in a retracted position relative to the frame.
Figure 4:
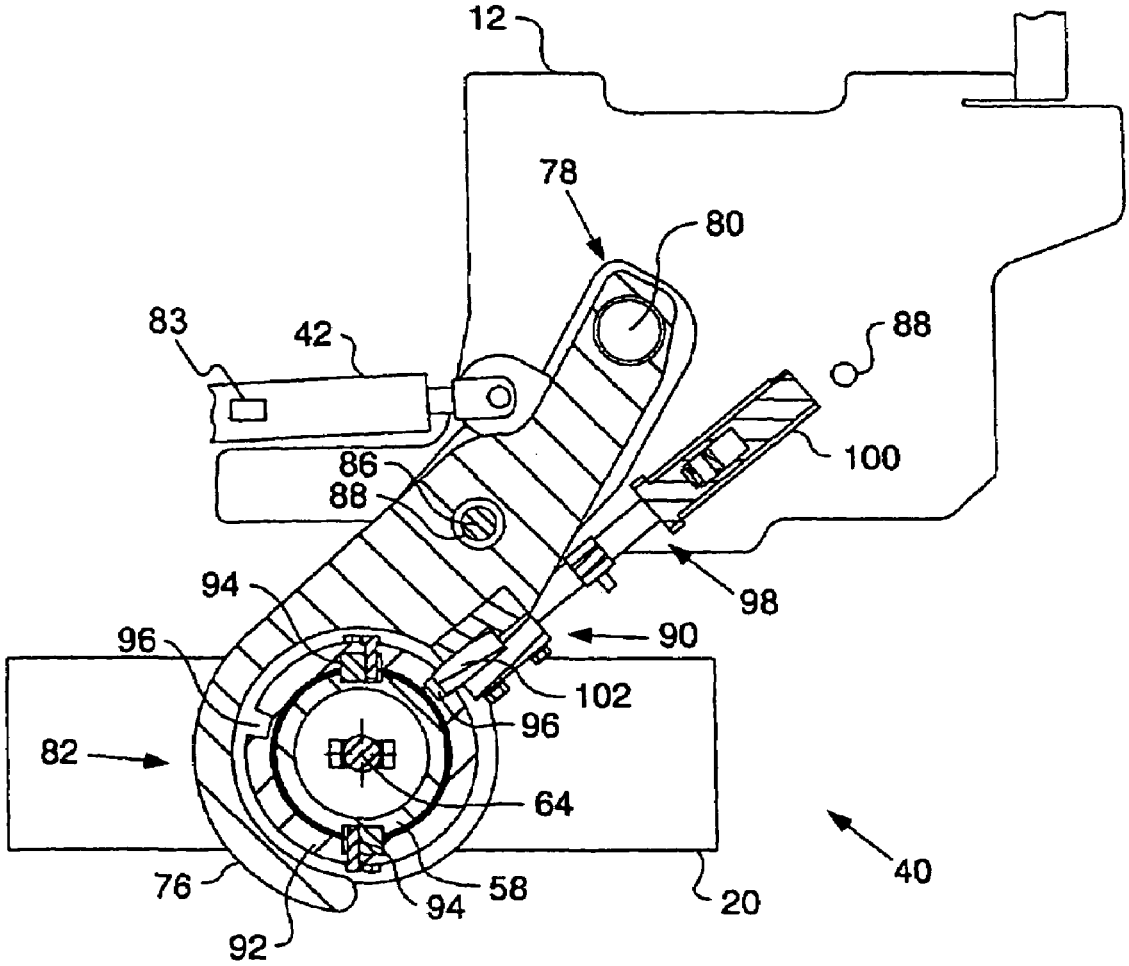
FIG. 4 is a partially sectioned top plan view of the apparatus of FIG. 2, with the ground engaging unit arranged in a protracting position relative to the frame.
Figure 5:
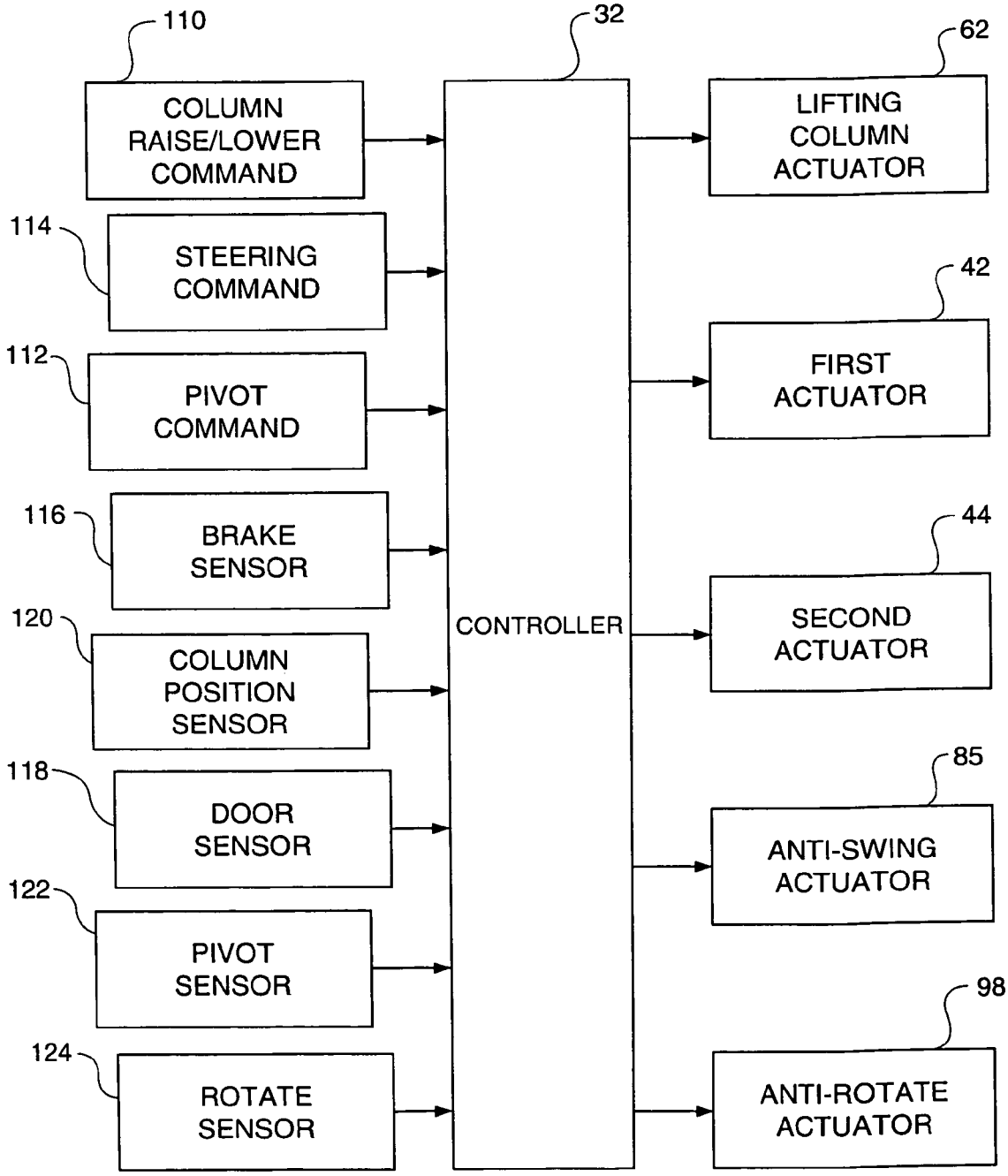
FIG. 5 is a block diagram of control logic associated with an embodiment of the present invention.

Referring now primarily to FIGS. 2 through 4, the work machine 10 includes a support device 40 connected between the machine frame 12 and the one ground engaging unit 20. A first actuator 42 is connected to the support device 40 and is adapted to move the one ground engaging unit 20 between the projecting position (see FIG. 4) and the retracted position (see FIG. 3) relative to the frame 12. A second actuator 44 is associated with the support device 40 and is adapted to maintain the same rotational direction of the one ground engaging unit 20 in each of the projecting and retracted positions. Each of the first and second actuators 42, 44 is associated with the controller 32, which is adapted to coordinate the actuation of the actuators 42, 44.

The support device 40 includes a lifting column 46 adapted to controllably raise and lower the associated connected ground engaging unit 20 relative to the machine frame 12. In a typical embodiment of the work machine 10, each of the ground engaging units 14, 16, 18, 20 will include a respective support device 40 and lifting column 46. The second actuator 44 is connected to the lifting column 46 and is adapted to cause at least a portion of the lifting column 46 to rotate about a lifting column axis 48 that is oriented generally vertically relative to the work machine 12.

In one of the preferred embodiments, at least one of the first and second actuators 42, 44 is a rotary actuator. An actuator of the sort available from the Helac Corporation of Enumclaw, Wash., for example, the L20 Series Hydraulic Rotary Actuator, has been found to be particularly advantageous in this application. This actuator uses a double helix sliding spline design to produce high torque rotary motion in a compact device. However, other rotary actuators such as worm or sun gear designs that are well-known mechanical implementations may also be employed with good result. Such use of a rotary actuator provides a compact apparatus to achieve rotary motion without the need for complicated and bulky linkages, and may also be used to provide fine rotary steering control.

In another of the preferred embodiments, the second actuator 44 is positioned on the lifting column 46 at a location spaced apart from the first actuator 42 along the lifting column axis 48. Preferably, the second actuator 44 is located at an upper portion 50 of the lifting column 46 and the first actuator 42 is located at a lower portion 52 of the lifting column 46. Such spaced apart positioning avoids problems caused by an accumulation of mechanical devices at a single location on the lifting column 46.

These embodiments may be advantageously combined by employing a rotary actuator as described above as either or both of the first and second actuators 42, 44, and by positioning these actuators at the specified longitudinally spaced apart locations. In this respect, it may also be preferable that at least the second actuator 44 be implemented using the rotary actuator construction and placed at the upper portion of the lifting column 46.

As best seen in FIG. 2, the one ground engaging unit 20 is supported by a bracket 54. The bracket 54 may be a simple axial wheel support as pictured, or may support a track section having rollers, tensioning devices, etc., as is well-known in the art. In either case, the track or wheel is adapted to revolve in both forward and reverse directions about an axis 56.

The lifting column 46 is preferably a hydraulically actuated mechanism that includes an inner tubular member 58 that is slidable within an outer tubular member 60. The inner tubular member 58 is connected to the bracket 54, and the outer tubular member 60 is connected to a component of the support device 40 which is pivotally connected to the machine frame 12.

The inner tubular member 58 may be moved longitudinally vertically relative to the outer tubular member 60 by means of a lifting column actuator 62. The lifting column actuator 62 includes a piston rod 64 connected at one end to the bracket 54 and slidable within a cylinder 66. The cylinder 66 is supported in a rotatably slidable arrangement at one end by a flange 68 that rests on the outer tubular member 60. The piston rod 64 and cylinder 66 together constitute a linear hydraulic actuator in which the piston rod 64 may be driven in or out of the cylinder 66 by the application of hydraulic fluid (not shown). Such linear movement of the piston rod 64 causes the inner tubular member 58 to move axially within the outer tubular member 60, in turn causing the associated ground engaging unit 20 to move generally vertically relative to the machine frame 12.

In a preferred embodiment, the housing of the second actuator 44 is connected, for example by bolts, to the top of the outer tubular member 60. A rotor 70 of the second actuator 44 includes one or more protrusions 72 that project into mating recesses in the top of the cylinder 66. Consequently, rotation of the second actuator rotor 70 causes the cylinder 66 to rotate as the cylinder flange 68 slides on the outer tubular member 60. Free sliding rotation of the flange 68 may be enhanced as desired with, for example, lubricants, anti-friction materials such as TFE, or bearings. The cylinder 66 is engaged with the inner tubular member 58 by a pair of keys 74 fitted into corresponding longitudinal keyways. This key and keyway arrangement permits linear sliding movement between the inner tubular member 58 and the cylinder 66, while preventing relative rotational movement between these components. As a result, actuation of the lifting column actuator 62 moves the one ground engaging unit 20 up and down vertically relative to the machine frame 12, and actuation of the second actuator 44 moves the one ground engaging unit 20 rotationally about the lifting column axis 48. A rotation sensor 75, for example, a rotary encoder, may be associated with the second actuator 44 or with a connected rotating component to deliver signals representing the rotation angle of the one ground engaging unit 20 relative to the machine frame 12.

The support device 40 includes a swing arm 76 having a first end portion 78 pivotally connectable to the machine frame 12 with a pivot pin 80, and a second end portion 82 connected to the outer tubular member 60. Consequently, the machine frame 12 supports the swing arm 76 and outer tubular member 60, which in turn supports the lifting column actuator 62 which is connected to the bracket 54 holding the one ground engaging unit 20. Actuation of the first actuator 42 causes the swing arm 76 to pivot about the pivot pin 80, moving the one ground engaging unit 20 between the projecting and retracted positions. A pivot sensor 83, for example, a linear sensor associated with the first actuator 42 or a rotary encoder associated with the pivot pin 80 may deliver signals representing the pivot angle of the one ground engaging unit 20 relative to the machine frame 12.

An anti-swing device 84 connected to the swing arm 76 includes an anti-swing actuator 85 having a protrusion 86 that is controllably engageable with either of a pair of receptacles 88 such as holes or recesses in the machine frame 12. The protrusion 86 may be deployed in response to the one ground engaging unit 20 being positioned at either of the protruding and retracted positions. This locks the swing arm 76 against unintentional pivotal movement relative to the machine frame 12. The anti-swing device 84 may conveniently be hydraulically or electrically actuated, although it could also be manually actuated.

An anti-rotate device 90 includes a collar 92 connected with collar keys 94 to the inner tubular member 58, causing the collar 92 to rotate along with the inner tubular member 58 in response to actuation of the second actuator 44. The collar 90 includes a pair of receptacles 96 such as holes or recesses in spaced apart locations about the collar periphery. An anti-rotate actuator 98 includes a body portion 100 connected to the machine frame 12 and a protrusion 102 controllably engageable with either of the pair of collar receptacles 96 in response to the one ground engaging unit 20 being directionally aligned with the machine frame 12 and being positioned at a corresponding respective one of the projecting and retracted positions. This permits locking the inner tubular member 58 and the one ground engaging unit 20 against unintentional rotational movement when steering control of the one ground engaging unit 20 is not desired. The anti-rotate device 90 may conveniently be hydraulically or electrically actuated, although it could also be manually actuated.

The controller 32 includes a plurality of input interfaces for receiving information and command signals from various switches and sensors associated with the work machine 10 and a plurality of output interfaces for sending control signals to various actuators associated with the work machine 10. Only those input and output interfaces pertinent to the instant inventive embodiments are described below, but the suitably programmed controller 32 may serve many additional similar or wholly disparate functions as is well-known in the art.

On the input side, the controller 32 may receive signals from one or more of the following: an operator initiated raise/lower switch command 110 to raise or lower one or more of the lifting columns; an operator initiated pivot switch command 112 to pivot or swing the one ground engaging unit 20 from one of the projecting and retracted positions to the other; a steering command 114 from the steering command element 26; a brake set signal 116 from a sensor such as a micro-switch associated with the machine parking brake (not shown) indicating that the brake is set and the machine 10 is stopped; a machine recess door position signal 118 from a sensor such as a micro-switch (not shown) indicating that a door covering the recess 22 is open or closed; a lifting column vertical position signal 120; a ground engaging unit pivot position signal 122; and a ground engaging unit rotational position signal 124.

The lifting column vertical position signal 120 may be produced by a sensor such as a micro-switch or linear position sensor (not shown) associated with the lifting column indicating that the one ground engaging unit 20 is in a position free from engagement with the ground such that it may be pivoted relative to the machine frame 12. The ground engaging unit pivot position signal 122 is from the pivot sensor 83 associated with the first actuator 42 or the swing arm 76 indicating the instantaneous angular position of the swing arm 76 relative to the machine frame 12. The ground engaging unit rotational position signal 124 is from the rotation sensor 75 associated with the second actuator 44 indicating the instantaneous rotation angle of the one ground engaging unit 20 relative to the machine frame 20.

On the output side, the controller 32 may send control signals to one or more of the following: the lifting column actuator 62; the first actuator 42; the second actuator 44; the anti-swing actuator 85; and the anti-rotate actuator 98. In the case of electrically activated actuators, the control signals may act directly on the respective actuators. In the case of hydraulically activated actuators, the control signals may act on electrically controlled valves which in turn control the flow of pressurized oil to the actuators. The controller 32 may be a separate control unit or it may be part of a central control unit operable to control additional functions of the work machine 10. In view of the foregoing disclosure, one skilled in the art may readily conceive or identify additional configurations of the controller 32 sufficient to realize the desired control functions.

INDUSTRIAL APPLICABILITY

A work machine 10 equipped as described above may be operated in the following manner:

Absent conditions calling for flush milling, the work machine 10 may be configured as shown in FIG. 4, with the one ground engaging unit 20 in the projecting or outboard position relative to the machine frame 12. This configuration positions the ground engaging units 14, 16, 18, 20 in a conventional axially aligned four point stance for maximum machine stability.

When flush milling is desired, for example, along a curb or close to a wall, the operator may choose to move the one ground engaging unit 20 to the retracted position relative to the machine frame 12, as shown in FIG. 3. In the preferred embodiment disclosed above, this may be accomplished as follows:

First, the operator stops the machine 10 and engages the parking brake which sends a brake set signal 116 to the controller 32.

Next, the operator ensures that the door covering the recess 22 is open, which sends a door position signal 118 to the controller 32.

Next, the operator engages the lifting column raise/lower switch which sends a column switch command 110 to the controller 32, commanding that the lifting column 46 be raised relative to the machine frame 12. The controller 32 responsively actuates the lifting column actuator 62, causing the piston rod 64 to retract into the cylinder 66 and raising the ground engaging unit 20 relative to the machine frame 12. This effectively lowers the frame 12 relative to the ground until the milling roller 30 or some other element associated with the frame 12 engages the ground and the ground engaging unit 20 becomes free from ground engagement. Once a desired predetermined height of the one ground engaging unit 20 is reached, the lifting column vertical position signal 120 is delivered to the controller 32 and the lifting column actuator 62 is deactivated. Typically, both of the rear ground engaging units 18, 20 are raised at the same time to keep the machine level.

Next, the operator engages the pivot switch which sends a pivot switch command 112 to the controller 32, commanding that the one ground engaging unit 20 move from the projecting position to the retracted position. In response to receiving the permissive signals indicating that the machine is safely stopped, the recess cover is open, and the one ground engaging unit 20 is suitably elevated, the controller 32 activates the anti-swing actuator 85 and the anti-rotate actuator 98 to release the corresponding protrusions 86, 102 from engagement with the respective receptacles 88, 96. Alternatively, these locking devices could be released by separate operator controlled switches or even manually, but automatic release is provided for the convenience of the operator.

The controller 32 then actuates the first actuator 42 and begins moving the swing arm 76. The pivot sensor 83 tracks this motion and sends responsive pivot position signals 122 to the controller 32. The controller 32 responsively actuates the second actuator 44 to counter-rotate the one ground engaging unit 20 to maintain it in the same running direction as it moves toward the retracted position.

As counter-rotation begins, the rotation sensor 75 sends rotation position signals 124 to the controller 32. The controller 32 uses the pivot and rotation signals 122, 124 to coordinate activation of the first and second actuators 42, 44. For example, the controller 32 may coordinate the actuators 42, 44 in a manner to cause the counter-rotation of the one ground engaging unit 20 to continuously and precisely offset the rotation caused by the pivoting, resulting in the one ground engaging unit 20 remaining parallel to the machine frame 12 at all points in the pivot arc. Conversely, the controller 32 may coordinate the actuators 42, 44 according to a different predetermined algorithm in a manner to cause the counter-rotation to be out of synchronization with the pivoting at various points in the pivot arc, for example to provide a better entry angle of the one ground engaging unit 20 into the recess 22, while still causing the one ground engaging unit 20 to begin and end the transition from projecting to retracted positions parallel to the machine frame 12. Consequently, use of the separate first and second actuators 42, 44 and the programmed controller 32 provides great flexibility in controlling the transition of the one ground engaging unit 20 between projecting and retracted positions.

Once the controller 32 receives the pivot and rotation signals 122, 124 indicating that the transition from projecting to retracted status is complete, the anti-swing and anti-rotate actuators 85, 98 may be again actuated by the controller 32 to lock the corresponding mechanical elements and to prevent unintentional movement.

Next, the operator again engages the lifting column raise/lower switch in the opposite manner as before, which sends a column switch command 110 to the controller 32 commanding that the lifting column 46 be lowered relative to the machine frame 12. The controller 32 responsively actuates the lifting column actuator 62, causing the piston rod 64 to extend from the cylinder 66 and lowering the ground engaging unit 20 relative to the machine frame 12. This effectively places the one ground engaging unit 20 back in contact with the ground, and then raises the frame 12 and the milling roller 30 back to a desired operational height. The operator is then free to close the door over the recess 22 and may begin flush milling operations.

Returning the working machine 10 to the original stance with the one ground engaging unit in the projecting position is simply a matter of reversing the above delineated sequence.

In the event that it is desired to take advantage of the capability of steering the one ground engaging unit 20 using the second actuator 44, the controller 32 deactivates the anti-rotate actuator 98. In response to receiving the steering command 114 from the steering command element 26, the controller 32 actuates the second actuator 44 to produce calculated steering angles of the one ground engaging unit 20. Such steering may optionally be accomplished only when the one ground engaging unit 20 is in the retracted position. This is advantageous because in this position the two rear ground engaging units 18, 20 are not axially aligned and failure to steer the retracted one of the ground engaging units 20 will result in dragging the unit, especially if it is a track section, across the ground or pavement surface. If it is desired to steer both of the rear ground engaging units 18, 20, the non-pivotable unit 18 may be fitted with a rotation sensor and actuator in a manner similar to that of the pivotable unit 20, and the controller 32 may be programmed accordingly. Likewise, if it is desired to steer the rear ground engaging units 18, 20 when they are axially aligned, the controller 32 may also be programmed to calculate and control the correct steering angles in accordance with the Ackerman principle.

Accordingly, with the mere addition of sufficient rotation sensors and actuators it is possible for a programmed controller 32 to rotate and steer each wheel or track section either independently or in coordination with each other, both when the one wheel or track segment 20 is in the retracted position and when it is in the projecting position.

The described embodiments of the invention provide a simple, rugged, and automatic system that advantageously solves many problems associated with prior systems. The controller 32 combined with the described apparatus accomplishes the transition of the one ground engaging unit 20 between operating positions in a flexible controlled manner while maintaining the rotational or running direction, avoids bulky mechanical devises and linkages, and also selectively provides Ackerman correct steering capability.

Although specific preferred embodiments of the invention are described in detail above, in the light of the overall disclosure one skilled in the art may conceive modifications and variations not particularly addressed in the above description. For example, many specifically described structural components and arrangements of such components may be substituted by other components and arrangements without deviating from the described invention. Other aspects, objects and advantages of this invention can be obtained from a study of the drawings, the disclosure, and the appended claims.

What is claimed is

1. A self-propelled machine, comprising:

a machine frame supportable by a plurality of ground engaging units;

a support device connected between said machine frame and at least one of said ground engaging units, the support device including a lifting column having a lifting column axis oriented generally vertically relative to the machine frame, the lifting column being configured to controllably raise and lower said at least one ground engaging unit relative to the machine frame;

a first actuator connected to said support device and located at a lower portion of the lifting column, and adapted to move said at least one ground engaging unit between projecting and retracted positions relative to said machine frame;

a second actuator associated with said at least one ground engaging unit, wherein the second actuator is a rotary actuator located at an upper portion of the lifting column spaced apart from the first actuator along the lifting column axis, and adapted to cause at least a portion of the lifting column to rotate about the lifting column axis and to maintain the same rotational direction of said at least one ground engaging unit in each of said projecting and retracted positions; and a controller associated with and adapted to coordinate the actuation of said first and second actuators.

2. A machine, as set forth in claim 1, wherein said rotary actuator has a rotor operatively engaged with a portion of said lifting column.

3. A machine, as set forth in claim 1, including at least a rotation sensor adapted to produce an alignment signal indicative of the rotational position of said at least one ground engaging unit relative to said machine frame, said rotation sensor being connected to deliver said alignment signal to said controller.

4. A machine, as set forth in claim 3, wherein said controller receives said alignment signal from said rotation sensor and responsively actuates said second actuator to maintain the rotational direction of said at least one ground engaging unit.

5. A machine, as set forth in claim 3, including a pivot sensor adapted to produce a position signal indicative of the position of said at least one ground engaging unit relative to said machine frame between said projecting and retracted positions, said pivot sensor being connected to deliver said position signal to said controller.

6. A machine, as set forth in claim 5, wherein said controller receives said alignment signal from said rotation sensor and said position signal from said pivot sensor and responsively coordinates the actuation of said first and second actuators in a predetermined manner.

7. A machine, as set forth in claim 6, wherein said rotation sensor is a rotary sensor associated with said second actuator, and said pivot sensor is a linear sensor associated with said first actuator.

8. A machine, as set forth in claim 5, including a steering command element connected to said controller; and wherein said controller is adapted to controllably actuate said second actuator to rotate said at least one ground engaging unit about said lifting column axis in response to said pivot sensor position signal and said steering command element.

9. A machine, as set forth in claim 8, wherein said controller is adapted to controllably actuate said second actuator in a first manner in response to said at least one ground engaging element being at said projecting position, and in a second different manner in response to said at least one ground engaging unit being at said retracted position.

10. A machine, as set forth in claim 9, wherein said controller actuates said second actuator in a manner adapted to provide Ackerman corrected steer angles for said at least one ground engaging unit.

11. A machine, as set forth in claim 1, wherein said support device includes a swing arm having a first end portion connected to said machine frame and a second end portion connected to said lifting column.

12. A machine, as set forth in claim 11, wherein said first actuator is a linear actuator having a first end connected to said machine frame and a second end connected to said swing arm.

13. A machine, as set forth in claim 1, wherein said at least one ground engaging unit includes one of a track section and a wheel.

14. A machine, as set forth in claim 1, wherein said controller includes a programmable logic device connected to a memory device.

15. A machine, as set forth in claim 1, including an anti-swing device having a protrusion controllably engageable with a respective one of a pair of receptacles in response to said at least one ground engaging unit being positioned at a corresponding respective one of said projecting and retracted positions.

16. A machine, as set forth in claim 1, including an anti-rotate device having a protrusion controllably engageable with a respective one of a pair of receptacles in response to said at least one ground engaging unit being directionally aligned with said machine frame and being positioned at a corresponding respective one of said projecting and retracted positions.

17. A machine, as set forth in claim 1, including a pivot sensor adapted to produce a position signal indicative of the position of said at least one ground engaging unit relative to said machine frame between said projecting and retracted positions, said pivot sensor being connected to deliver said position signal to said controller.

18. A self-propelled machine, comprising:

a machine frame supportable by a plurality of ground engaging units;

a support device connected between said machine frame and at least one of said ground engaging units, said support device including a lifting column having a lifting column axis and being adapted to controllably raise and lower said at least one ground engaging unit about said axis relative to said machine frame;

a first actuator connected to said support device and adapted to move said at least one ground engaging unit between projecting and retracted positions relative to said machine frame; and a second actuator connected to said lifting column and adapted to cause at least a portion of said lifting column to rotate about said lifting column axis relative to said machine frame, said second actuator being positioned at a location linearly spaced apart from said first actuator along said lifting column axis.

19. A machine, as set forth in claim 18, wherein said second actuator is located at an upper portion of said lifting column and said first actuator is located at a lower portion of said lifting column.

20. A machine, as set forth in claim 18, wherein said second actuator is a rotary actuator having a rotor operatively engaged with a portion of said lifting column.

21. A machine, as set forth in claim 18, including a controller associated with and adapted to coordinate the actuation of said first and second actuators, said machine including at least a rotation sensor adapted to produce an alignment signal indicative of the rotational position of said at least one ground engaging unit relative to said machine frame, said rotation sensor being connected to deliver said alignment signal to said controller.

22. A machine, as set forth in claim 21, wherein said controller receives said alignment signal from said rotation sensor and responsively actuates said second actuator to maintain the rotational direction of said at least one ground engaging unit.

23. A machine, as set forth in claim 21, including a pivot sensor adapted to produce a position signal indicative of the position of said at least one ground engaging unit relative to said machine frame between said projecting and retracted positions, said pivot sensor being connected to deliver said position signal to said controller.

24. A machine, as set forth in claim 23, wherein said controller receives said alignment signal from said rotation sensor and said position signal from said pivot sensor and responsively coordinates the actuation of said first and second actuators in a predetermined manner.

25. A machine, as set forth in claim 24, wherein said rotation sensor is a rotary sensor associated with said second actuator, and said pivot sensor is a linear sensor associated with said first actuator.

26. A machine, as set forth in claim 23, including a steering command element connected to said controller; and wherein said controller is adapted to controllably actuate said second actuator to rotate said at least one ground engaging unit about said lifting column axis in response to said pivot sensor position signal and said steering command element.

27. A machine, as set forth in claim 26, wherein said controller is adapted to controllably actuate said second actuator in a first manner in response to said at least one ground engaging element being at said projecting position, and in a second manner different from said first manner in response to said one ground engaging unit being at said retracted position.

28. A machine, as set forth in claim 27, wherein said controller actuates said second actuator in a manner adapted to provide Ackerman corrected steer angles for said at least one ground engaging unit.

29. A machine, as set forth in claim 18, wherein said support device includes a swing arm having a first end portion connected to said machine frame and a second end portion connected to said lifting column.

30. A machine, as set forth in claim 29, wherein said first actuator is a linear actuator having a first end connected to said machine frame and a second end connected to said swing arm.

31. A machine, as set forth in claim 18, wherein said at least one ground engaging unit includes one of a track section and a wheel.

32. A machine, as set forth in claim 18, wherein said controller includes a programmable logic device connected to a memory device.

33. A machine, as set forth in claim 18, including an anti-swing device having a protrusion controllably engageable with a respective one of a pair of receptacles in response to said at least one ground engaging unit being positioned at a corresponding respective one of said projecting and retracted positions.

34. A machine, as set forth in claim 18, including an anti-rotate device having a protrusion controllably engageable with a respective one of a pair of receptacles in response to said at least one ground engaging unit being directionally aligned with said machine frame and being positioned at a corresponding respective one of said projecting and retracted positions.

35. A machine, as set forth in claim 18, including a controller associated with and adapted to coordinate the actuation of said first and second actuators, and including a pivot sensor adapted to produce a position signal indicative of the position of said at least one ground engaging unit relative to said machine frame between said projecting and retracted positions, said pivot sensor being connected to deliver said position signal to said controller.

36. A method of controlling a pair of actuators connected to a controller, at least one of said actuators being a rotary actuator, to selectively position one of a plurality of ground engaging units connected to a respective lifting column having a lifting column axis and supporting a frame of a self-propelled machine, comprising:

raising said one ground engaging unit with said lifting column until said one ground engaging unit is free from engagement with the ground;

actuating a first one of said actuator pair to move said one ground engaging unit from one to the other of said projecting and retracted positions relative to said machine frame;

actuating a second one of said actuator pair to rotate said one ground engaging unit about said lifting column axis in a manner coordinated with the actuation of said first actuator to maintain the same rotational direction of said ground engaging unit in each of said projecting and retracted positions wherein said first one of said actuator pair and said second one of said actuator pair are positioned at locations spaced apart axially along said lift column axis; and lowering said one ground engaging unit with said lifting column until said one ground engaging unit is again in frame supporting engagement with the ground.

37. A method, as set forth in claim 36, wherein said machine includes at least a rotation sensor connected to said controller and associated with said one ground engaging unit and adapted to produce an alignment signal indicative of the rotational position of said one ground engaging unit about said lifting column axis relative to said machine frame, including:

receiving said alignment signal and responsively controllably actuating said second actuator.

38. A method, as set forth in claim 37, wherein said machine includes a pivot sensor connected to said controller and associated with said one ground engaging unit and adapted to produce a position signal indicative of the position of said one ground engaging unit relative to said machine frame between said projecting and retracted positions, including:

receiving said alignment signal from said rotation sensor and said position signal from said pivot sensor and responsively coordinating the actuation of said first and second actuators in a predetermined manner.

39. A method, as set forth in claim 38, wherein said machine includes a steering command element connected to said controller, including:

controllably actuating said second actuator to rotate said one ground engaging unit about said lifting column axis in response to said pivot sensor position signal and said steering command element.

40. A method, as set forth in claim 39, including:

controllably actuating said second actuator in a first manner in response to said one ground engaging unit being at said projecting position; and controllably actuating said second actuator in a second manner different from said first manner in response to said one ground engaging unit being at said retracted position.

41. A method, as set forth in claim 40, wherein said controller controllably actuates said second actuator to produce Ackerman corrected steer angles for said one ground engaging unit.

42. A method, as set forth in claim 36, wherein said machine includes an anti-swing device, including:

disengaging said anti-swing device prior to actuating said first actuator; and engaging said anti-swing device in response to said one ground engaging unit being moved from said one of said projecting and retracted positions to said other of said projecting and retracted positions.

43. A method, as set forth in claim 36, wherein said machine includes an anti-rotate device, including:

engaging said anti-rotate device in response to said one ground engaging unit being in either of said projecting and retracted positions; and disengaging said anti-rotate device prior to actuating said second actuator.

44. A method, as set forth in claim 36, wherein said machine includes a pivot sensor connected to said controller and associated with said one ground engaging unit and adapted to produce a position signal indicative of the position of said one ground engaging unit relative to said machine frame between said projecting and retracted positions, including:

receiving said position signal from said pivot sensor and responsively coordinating the actuation of said first and second actuators in a predetermined manner.

45. A self-propelled machine, comprising:

a machine frame supportable by a plurality of ground engaging units;

support means for supporting said machine frame, said support means being connected to said machine frame and including a generally vertically oriented lifting column having a lifting column axis and being connected to at least one of said ground engaging units;

first actuatable means for moving said at least one ground engaging unit between projecting and retracted positions relative to said machine frame;

second actuatable means for rotating said at least one ground engaging unit to maintain the same rotational direction of said at least one ground engaging unit in each of said projecting and retracted positions, said second actuatable means being positioned at a location spaced apart from said first actuatable means along an axis of said lifting column; and controller means for coordinating the actuation of said first and second actuatable means.

46. A machine, as set forth in claim 45, wherein said second actuatable means is located at an upper portion of said lifting column and said first actuatable means is located at a lower portion of said lifting column.

47. A machine, as set forth in claim 46, wherein said second actuatable means is a rotary actuator.

48. A machine, as set forth in claim 47, wherein said second actuatable means has a rotor operatively engaged with a portion of said lifting column.

49. A machine, as set forth in claim 45, including at least rotation sensor means for producing an alignment signal indicative of the rotational position of said one ground engaging unit relative to said machine frame, and for delivering said alignment signal to said controller means.

50. A machine, as set forth in claim 49, wherein said controller means receives said alignment signal from said rotation sensor means and responsively actuates said second actuatable means to maintain the rotational direction of said one ground engaging unit.

51. A machine, as set forth in claim 49, including pivot sensor means for producing a position signal indicative of the position of said at least one ground engaging unit relative to said machine frame between said projecting and retracted positions, and for delivering said position signal to said controller means.

52. A machine, as set forth in claim 51, wherein said controller means receives said alignment signal from said rotation sensor means and said position signal from said pivot sensor means and responsively coordinates the actuation of said first and second actuatable means in a predetermined manner.

53. A machine, as set forth in claim 52, wherein said rotation sensor means is a rotary sensor associated with said second actuatable means, and said pivot sensor means is a linear sensor associated with said first actuatable means.

54. A machine, as set forth in claim 51, including a steering command element connected to said controller means; and wherein said controller means controllably actuates said second actuatable means to rotate said at least one ground engaging unit about said lifting column axis in response to said pivot sensor position signal and said steering command element.

55. A machine, as set forth in claim 54, wherein said controller means is adapted to controllably actuate said second actuatable means to rotate said at least one ground engaging unit in a first manner in response to said at least one ground engaging element being at said projecting position, and in a second different manner in response to said at least one ground engaging unit being at said retracted position.

56. A machine, as set forth in claim 55, wherein said controller actuates said second actuator in a manner adapted to provide Ackerman corrected steer angles for said at least one ground engaging unit.

57. A machine, as set forth in claim 45, wherein said support means includes a swing arm having a first end portion connected to said machine frame and a second end portion connected to said lifting column.

58. A machine, as set forth in claim 57, wherein said first actuatable means is a linear actuator having a first end connected to said machine frame and a second end connected to said swing arm.

59. A machine, as set forth in claim 45, wherein said at least one ground engaging unit includes one of a track section and a wheel.

60. A machine, as set forth in claim 45, wherein said controller means includes a programmable logic device connected to a memory device.

61. A machine, as set forth in claim 45, including anti-swing means for preventing pivotal movement of said swing arm in response to said at least one ground engaging unit being positioned at a corresponding respective one of said projecting and retracted positions.

62. A machine, as set forth in claim 45, including anti-rotate means for preventing rotational movement of said at least one ground engaging unit in response to said one ground engaging unit being aligned with said machine frame and being positioned at a corresponding respective one of said projecting and retracted positions.

63. A machine, as set forth in claim 45, including pivot sensor means for producing a position signal indicative of the position of said at least one ground engaging unit relative to said machine frame between said projecting and retracted positions, and for delivering said position signal to said controller means.

* * * * *